United States Patent [19]

Hanson

[11] 4,304,055

[45] Dec. 8, 1981

[54] CLOSURE ASSEMBLY FOR FOOTWEAR

[75] Inventor: Chris A. Hanson, Boulder, Colo.

[73] Assignee: Hanson Industries Incorporated, Boulder, Colo.

[21] Appl. No.: 130,198

[22] Filed: Mar. 13, 1980

[51] Int. Cl.[3] ..... A43B 11/00; A43B 5/04

[52] U.S. Cl. ..... 36/50; 36/117; 24/68 SK

[58] Field of Search ..... 36/50, 117–120; 24/68 SK, 69 SK, 70 SK, 71 SK

[56] References Cited

FOREIGN PATENT DOCUMENTS

| | | | |
|---|---|---|---|
| 245434 | 2/1966 | Austria | 24/68 SK |
| 248918 | 8/1966 | Austria | 24/68 SK |
| 253384 | 4/1967 | Austria | 24/68 SK |
| 2005481 | 12/1969 | France | 24/68 SK |
| 595070 | 1/1978 | Switzerland | 24/68 SK |

*Primary Examiner*—James Kee Chi

*Attorney, Agent, or Firm*—Merriam, Marshall & Bicknell

[57] ABSTRACT

A closure assembly for footwear including ski boots in which a closure member having a lever end, engagement tooth and latch end is associated with a slotted tooth section molded on the footwear shell to open and close sections of the footwear.

20 Claims, 7 Drawing Figures

CLOSURE ASSEMBLY FOR FOOTWEAR

BACKGROUND OF THE INVENTION

The invention disclosed and claimed herein relates generally to a closure means for footwear and more specifically to a new and improved closure assembly for ski boots.

Conventionally, in ski boots and particularly plastic ski boots there is an elongated opening along the front, side, or back of the boot to facilitate entry into the boot of the skier's foot. One or more buckles are arranged along the length of one section of the boot shell located adjacent one side of the elongated opening and, on the section located adjacent the other side of the elongated opening, opposite each buckle, is a retainer pad which is adapted to receive a cable member. One portion of the cable member is attached or disposed within the pad while another portion of the cable member is engageable and disengageable with the buckle to lock and unlock the closure system. One such closure system is illustrated in U.S. Pat. No. 4,083,130.

While such closure systems have served to adequately secure the ski boot to a wearer's foot, several disadvantages have been found to exist. In some instances it has been found that it is necessary to exert a large force to close the buckle and in some applications, the person undertaking the boot closure assembly operation experiences difficulties in generating the force required to close a buckle member.

Further, it has been found that buckle arrangements presently available with ski boots do not always provide the desired degree of tightness desired by the person wearing the boot. More specifically, it has been found that when a boot wearer adjusts the closure system to provide the desired tightness of the boot about the wearer's foot, the buckle member is initially moved to the desired position which, in turn, pulls on the cable member drawing together the first and second boot sections adjacent the elongated opening. Subsequently, the buckle member is further moved to its closed, locked position which tightens and locks the boot about the foot of the wearer. Unfortunately, when the buckle is moved from its initial position to a locked position, it has been found that, in some instances, the wearer has to make additional adjustments to achieve the desired fit of the boot about the wearer's foot.

Additionally, buckle assemblies presently available comprise a plurality of parts. Each of the parts, such as the buckle member, must be assembled to the boot shell in a separate assembly operation. The utilization of a plurality of parts for the buckle closure system plus the operations required to assemble the closure assembly to the boot serve to increase the cost of manufacture of the boot.

What is desired is a closure assembly for footwear and particularly for use with ski boots which can be easily operated by a boot wearer to provide the required or desired fit of the boot about the foot of the wearer. One should also be able to lock or unlock the closure assembly without the need of excessive force. Further, it is desired that the closure assembly comprise a minimum of parts and assembly operations to reduce the time and expense associated with manufacturing the boot.

SUMMARY OF THE INVENTION

The invention disclosed and claimed herein serves to obviate the problems heretofore found with prior art closure assemblies and further serves to fulfill the desires sought with respect to footwear closure assemblies and particularly a closure assembly for a ski boot.

The closure assembly of the present invention includes a closure member which is attached to a first boot shell section or flap adjacent one side of an elongated foot entry or exit opening. The closure member is slidably movable in a slot located in the first shell section. The closure member also includes a latch means located at one end of the closure member which connects with a second boot shell section or flap located adjacent the opposite side of the elongated opening.

The closure member further comprises at least one tooth which engages a mating recess formed by a pair of teeth molded or otherwise located on the first section of the boot shell. The molded teeth are inclined to permit movement of the closure member in one direction only. The closure member traverses the elongated opening and the closure member latch engages a latch opening in the shell second section whereby the closure member closes the boot about the foot of the individual wearing the boot.

The closure member also includes a fulcrum which bears against the outer wall of the shell first section. The fulcrum serves to assist in moving the closure member from a locked to unlocked position. When the end of the closure member which is located opposite the closure member latch end is moved inward toward the boot shell, the closure member pivots about the fulcrum and the closure member tooth is disengaged from the recess located in the boot shell whereby the closure member moves to an open, unlocked position.

The closure member can be adjusted to the desired fitting position without the need of any relatively large force. Moreover, the closure of the closure assembly of the present invention is relatively easy to accomplish as it is only necessary to push the closure member forward to achieve the desired locked position as opposed to pulling on a buckle member used with buckle closure systems presently available.

The inclined tooth or ratchet section can be molded as an integral part of the shell configuration so that the closure assembly requires the assembly of only one member to the shell and that assembly can be readily and relatively easily accomplished.

Other features and advantages are inherent in the structure claimed and disclosed or will become apparent to those skilled in the art from the following detailed description in conjunction with the accompanying drawings.

DETAILED DESCRIPTION

Figure 1:
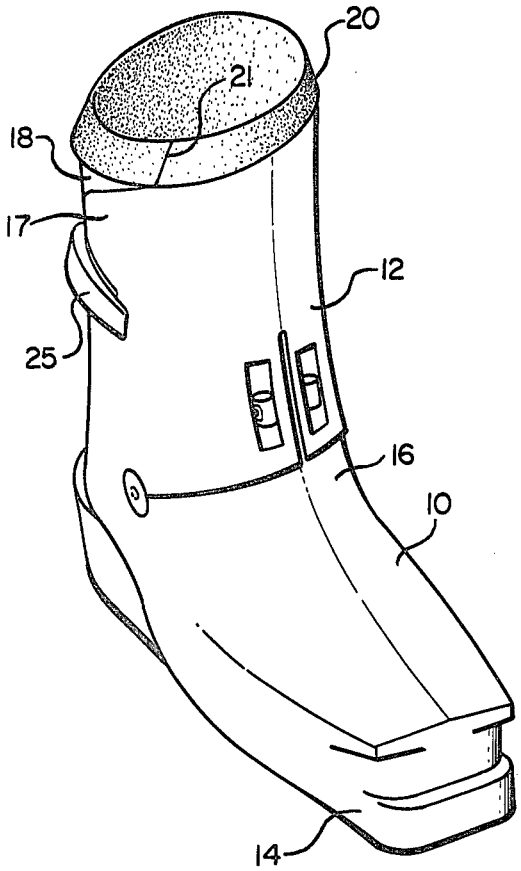
FIG. 1 shows a perspective view of footwear and more particularly a ski boot with a single closure assembly for closing the boot about the foot of a wearer.

Referring to the drawings, there is shown a ski boot 10 which comprises a semi-rigid plastic shell 12 including a sole 14 and a vamp 16. The shell can comprise several molded parts as shown, for example, in U.S. Pat. No. 3,848,347 where two complimentary shell portions are fastened together in a suitable manner or, as shown in FIG. 1, the shell 12 can comprise a one-piece shell which includes a shell flap or first footwear section 17 which is disposed over shell flap or second footwear section 18.

A one-piece liner member 20 which provides both fitting and padding functions for the wearer's foot is disposed within shell 12. The liner is disposed within the boot and extends upward beyond the top of the shell 12. The liner is split at 21 from the top to the bottom of the liner so that the liner can be spread apart to allow a person's foot to enter into and out of the boot liner. The liner can be made of polyurethane and a liner suitable for use with the boot shell is shown and disclosed in U.S. Pat. No. 3,798,799.

The boot shell is molded so that when the boot is located about the foot of the wearer, shell flap 17 having inner wall 22 and outer wall 23, overlaps shell flap 18 to provide a rear entry ski boot.

A closure assembly 25 is employed to close and lock the boot about the foot of a wearer. The closure assembly includes a closure member 26 which is normally attached to shell flap 17.

Closure member 26 which can be made of any suitable metal or plastic comprises an elongated, arcuate-shaped member having a latch end 27, a fulcrum section 28, a locking tooth 29 and a lever end 30.

Extending outward from the rear surface 31 of closure member 26 is rib 32. Post 33 is integrally attached and perpendicular to rib 32. Closure member 26 is also provided with a flexure section 34 which comprises a relatively thin section of the closure member located contiguous to tooth 29.

Figure 2:
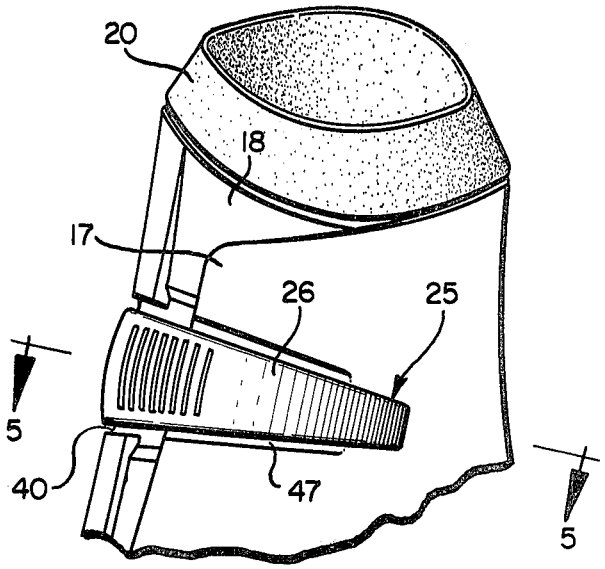
FIG. 2 shows an enlarged, fragmentary, side view of the ski boot of FIG. 1 and the closure member with the boot in a closed position as would occur when the boot is closed about the foot of a wearer of the ski boot.
Figure 3:
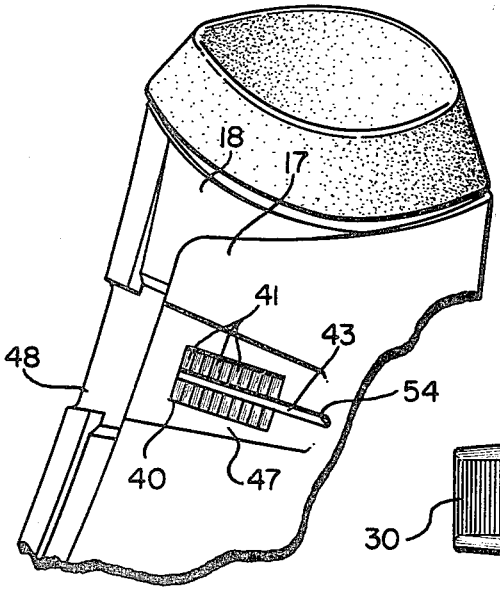
FIG. 3 shows an enlarged, fragmentary, side view of the ski boot of FIG. 1 with the closure member removed from the boot and a slotted tooth or ratchet section as an integral part of the wall of the boot shell.
Figure 4:
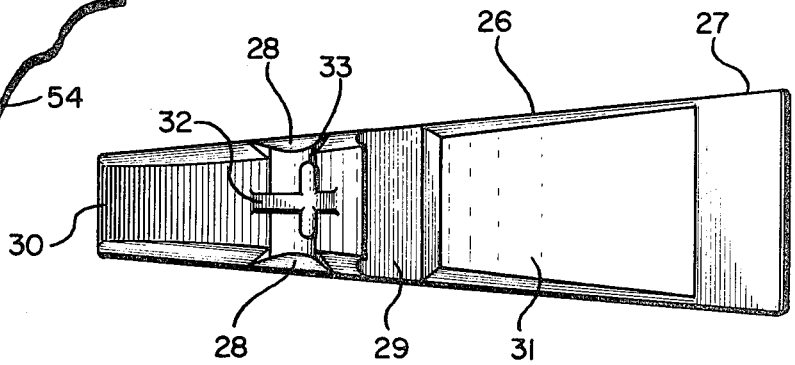
FIG. 4 shows a rear view of the closure member of the present invention.

Referring to FIGS. 2 and 3, closure member 26 is adapted to engage a pair of teeth in the tooth or ratchet section 40. Section 40 comprises a plurality of inclined teeth 41 molded into shell flap 17 as shown more clearly in FIGS. 3, 5 and 6. Slot 43 traverses teeth 41 and extends beyond section 40 as shown in FIG. 3.

Figure 5:
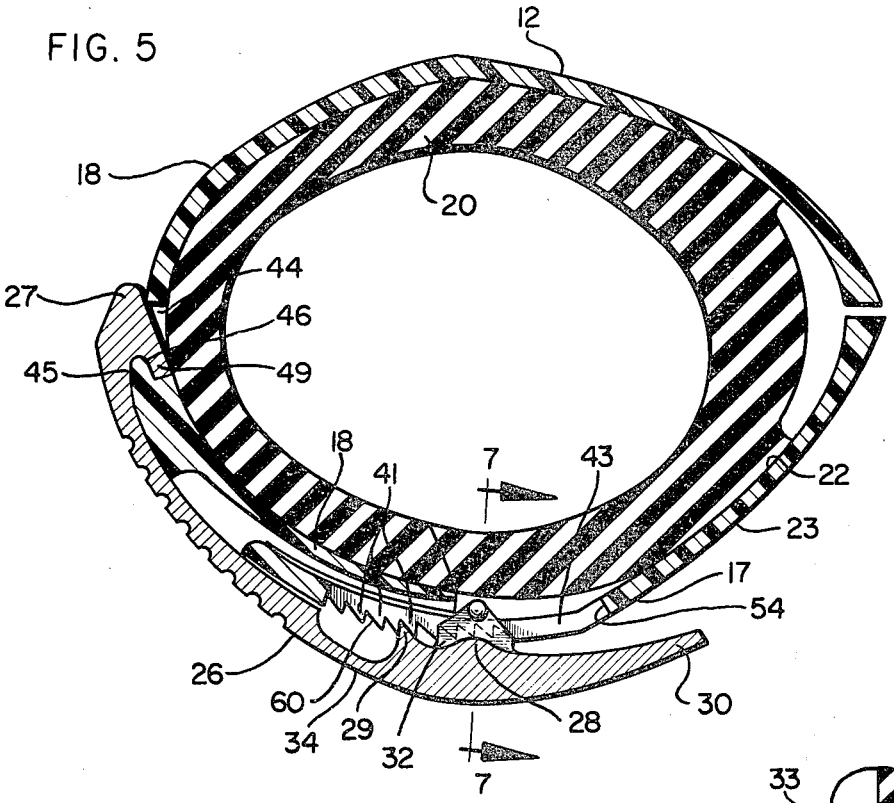
FIG. 5 shows a section view taken along lines 5—5 in FIG. 2 and shows the closure member of FIG. 4 fastened to the boot shell in a locked position.
Figure 6:
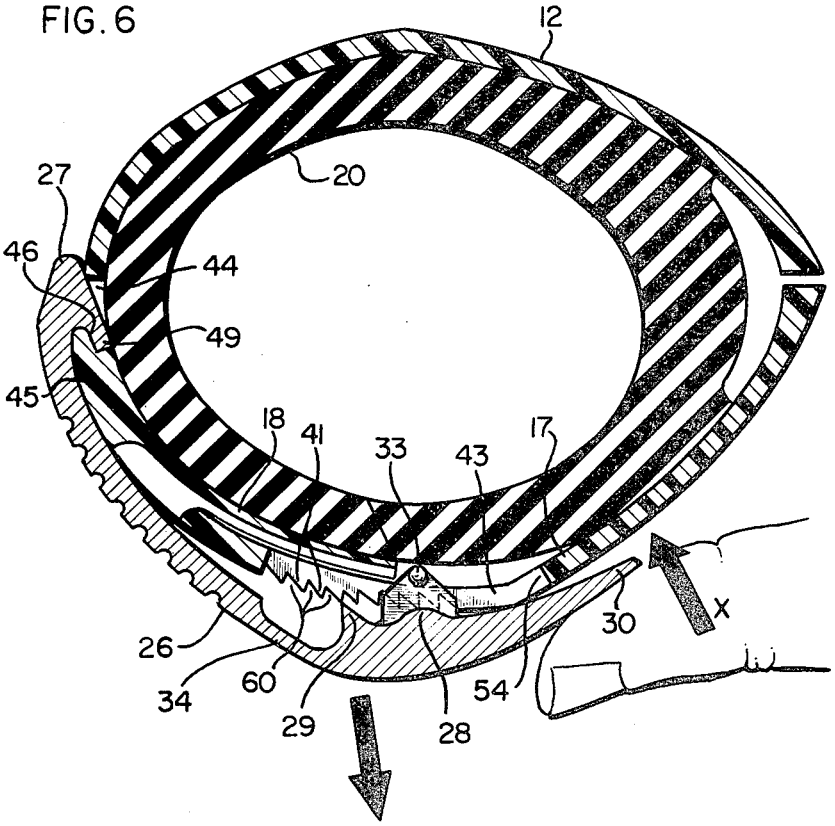
FIG. 6 shows the section view of FIG. 5 with the closure member having been moved from the locked position of FIG. 5 to a disengaging or unlocked position of FIG. 6; and, FIG. 7 shows a fragmentary, section view of the closure assembly of the present invention taken along lines 7—7 in FIG. 5 and shows the closure member connected to the shell with a closure member retainer post disposed adjacent the inner shell wall.

Flap 18, as shown in FIGS. 5 and 6, has an opening 44 located in the flap and a rib 45 having an undercut 46 extending outwardly from shell flap 18 adjacent opening 44. Opening 44 is preferably of a length slightly in excess of the width of latch end 27 on closure member 26.

Additionally, flaps 17 and 18 are each recessed at 47 and 48 respectively, FIGS. 2 and 3, so that closure member 26 can be disposed within the recess as shown in FIG. 2, when closure member 26 is in a locked position.

Figure 7:
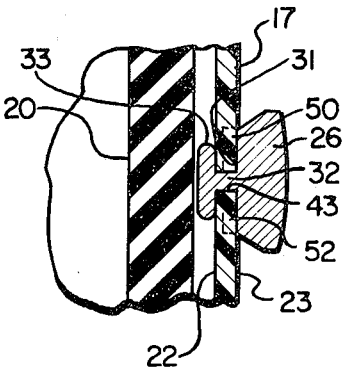

In assembly, closure member 26 is connected to shell flap 17 by inserting closure member post 33 through shell flap slot 43. As shown in FIG. 7, this assembly can be accomplished by moving shell section 50 which is located adjacent one of the two edges of slot 43 inward or outward relative to shell section 52 located adjacent the remaining edge of slot 43 so that post 33 can be inserted into the position illustrated in FIG. 7 where post 33 abuts the inner wall 22 of shell flap 17. With post 33 in this position, closure member 26 is attached to the shell flap 17 of boot 10 and is movable relative to the shell along the length of slot 43.

When a wearer has placed a foot in boot 10, latch end 27 of closure member 26 is placed in opening 44 so that latch extension 49 rests in the undercut or recess 46 as shown more clearly in FIGS. 5 and 6. When latch end 27 is disposed in opening 44 and seated against the rib 45, the boot is in an initial closed position. To lock the boot in the desired locked position, member 26 is pushed forward toward slot end 54. As closure member 26 moves forward in slot 43, tooth 29 passes over the teeth 41 in ratchet section 40 and engages with a recess formed by a pair of adjacent teeth 41 which are inclined or angled in the direction toward slot end 54 in order to permit movement of tooth 29 in one direction only. Tooth 29 is moved forward until the boot wearer senses the desired fit of the boot about the foot at which time closure member 26 is in a locked position with tooth 29 disposed in recess 60 formed by a pair of adjacent teeth 41.

When it is desired to release the boot from the closed, locked position illustrated in FIG. 5, an individual need only apply a force on lever end 30 to move end 30 inwardly in the direction shown by the arrow "x" in FIG. 6 whereupon closure member 26 will pivot about fulcrum section 28 which is seated against the outer wall 23 of shell flap 17. As closure member 26 pivots about fulcrum section 28, flexure section 34 permits flexure of member 26 so that tooth 29 is moved outwardly in the direction indicated by the arrow "y" until tooth 29 is removed from recess 60. The closure member can then be moved rearward in a direction away from slot end 54 to permit the boot to be opened so that it can be removed from a wearer's foot or the closure member can be moved to a different locking recess 60.

The closure arrangement shown in the drawings illustrates that closure member 26 is a separate member from boot 10. It is appreciated that, if desired, member 26 could be molded as part of the boot shell section 18 and, for example, post 33 could be a metal member attached in a swivel arrangement to rib 32 whereby the post could be swiveled so that it could be inserted through slot 43 and then rotated to a position as illustrated in FIG. 7.

Closure member 26 can be made of any suitable material such as a metal or plastic. The member must be structurally rigid to achieve the desired locking function but flexible at least in the area of flexure section 34 so that the tooth 29 can be disengaged from a recess 60 formed in tooth or ratchet section 40. Any suitable metal or plastic material could be utilized for the closure member.

While a rear entry ski boot has been shown in association with the closure assembly of the present invention, it is appreciated that the boot or footwear could be closed at any desired position. For example, a side or front entry boot could be utilized with the closure arrangement without departing from the invention. Similarly, while only one closure assembly 25 has been shown and illustrated, it is appreciated that more than one closure assembly of the present invention could be employed in serving to close a boot about the foot of the wearer.

It is also appreciated that the closure member could employ a different structural arrangement other than shown in the drawings without departing from the scope of the invention disclosed and claimed herein.

The foregoing detailed description has been given for clearness of understanding only and no unnecessary limitations should be understood therefrom as modifications will be obvious to those skilled in the art.

What is claimed is:

1. A closure assembly for opening and closing footwear about the foot of a wearer, wherein the footwear includes first and second sections adapted to be opened and closed relative to each other, said closure assembly comprising:

a closure member fastened to said first section and movable relative to said first section;

said closure member including means for connecting said closure member to said second section;

means for releasably locking said closure member to said first section; and wherein said first section includes an elongated slot and said closure member includes means disposed within said slot for fastening said closure member to said first section and for movement of said closure member along the length of said elongated slot.

2. A closure assembly in accordance with claim 1 wherein said closure means further includes a fulcrum means for pivoting said closure member about said first section to disengage said locking means.

3. A closure assembly in accordance with claim 2 wherein said first section includes a plurality of teeth disposed on said section forming at least one recess and said closure member includes at least one tooth adapted to be seated in said recess.

4. A closure assembly in accordance with claim 3 wherein said teeth are inclined in one direction.

5. A closure assembly in accordance with claim 1 wherein said second section connecting means includes a closure member latch means.

6. A closure assembly in accordance with claim 5 wherein said second shell section includes an opening disposed therein and said closure member latch means are adapted to be disposed within said opening.

7. A closure assembly in accordance with claim 1 wherein said footwear comprises a ski boot.

8. A closure assembly in accordance with claim 7 wherein said ski boot comprises a plastic shell.

9. A closure assembly for use with a ski boot having at least first and second sections adapted to be opened and closed relative to each other, said closure assembly comprising:

a closure member connected to and movably positioned on said first section;

means for connecting said closure member to said second section;

means for releasably locking said closure member to said first section; and wherein said first section includes at least one elongated slot and said closure member includes means disposed within said slot for fastening said closure member to said first section and for movement of said closure member along the length of said elongated slot.

10. A closure assembly in accordance with claim 9 wherein said closure member further includes a fulcrum means for pivoting said closure member about said fulcrum means to move said closure member from a locked to an unlocked position.

11. A closure assembly in accordance with claim 10 wherein said first section includes at least a pair of teeth forming a recess and said closure member includes a tooth adapted to be inserted in said recess to lock said closure member in position.

12. A closure assembly in accordance with claim 11 wherein said teeth are inclined in one direction.

13. A closure assembly in accordance with claim 1 or 9 wherein said closure member includes a latch end, a tooth, a lever end and a fulcrum section.

14. A closure assembly in accordance with claim 13 wherein said closure member includes a flexure section disposed contiguous to said closure member tooth.

15. A closure assembly in accordance with claims 1 or 9 wherein said closure member is plastic.

16. A closure assembly in accordance with claim 1 or 9 wherein said closure member is made of metal.

17. A closure assembly in accordance with claim 11 wherein said first section includes a ratchet section.

18. A closure assembly in accordance with claim 3 wherein said first section includes a ratchet section.

19. A closure assembly in accordance with claim 3 wherein said teeth are molded in said first section.

20. A closure assembly in accordance with claim 11 wherein said teeth are molded in said first section.

* * * * *